US006246021B1

(12) United States Patent
Thilker et al.

(10) Patent No.: US 6,246,021 B1
(45) Date of Patent: Jun. 12, 2001

(54) SWITCHING DEVICE

(75) Inventors: Lutz Thilker, Leichlingen; Albert Zacharias, Neuwied, both of (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/381,875

(22) PCT Filed: Mar. 11, 1998

(86) PCT No.: PCT/EP98/01386

§ 371 Date: Sep. 24, 1999

§ 102(e) Date: Sep. 24, 1999

(87) PCT Pub. No.: WO98/44524

PCT Pub. Date: Oct. 8, 1998

(30) Foreign Application Priority Data

Mar. 27, 1997 (DE) ..... 197 12 958

(51) Int. Cl.[7] ..... H01H 75/00

(52) U.S. Cl. ..... 200/288; 335/46; 335/16; 335/193

(58) Field of Search ..... 200/288; 218/22, 218/30, 31, 32; 35/16, 46, 193

(56) References Cited

U.S. PATENT DOCUMENTS 3,443,253 * 5/1969 Grimes et al. ..... 335/157
4,563,557 * 1/1986 Leone ..... 200/288
4,650,946 * 3/1987 Maier et al. ..... 200/288
4,891,617 * 1/1990 Beatty, Jr. et al. ..... 335/46
5,023,583 * 6/1991 Bratkowski et al. ..... 335/195
5,089,795 * 2/1992 Morgan et al. ..... 335/46
5,192,841 * 3/1993 Milianowicz et al. ..... 200/288

FOREIGN PATENT DOCUMENTS 10 25 041 2/1958 (DE) .
20 37 552 2/1972 (DE) .
37 25 860 2/1988 (DE) ..... H01H/77/10
42 01 956 7/1993 (DE) ..... H01H/33/66
295 10 909 U 9/1995 (DE) ..... H01H/71/46
0 353 950 2/1990 (EP) ..... H01H/3/60
1 048 980 12/1953 (FR) .

* cited by examiner

*Primary Examiner*—Michael Friedhofer
(74) *Attorney, Agent, or Firm*—Kenyon & Kenyon

(57) ABSTRACT

A switching device has an openable contact arrangement including at least one movable contact member disposed on a movable contact arm and at least one stationary contact member. At least one movable braking body is provided for limiting the movement of the contact arm in opening the contact arrangement. The inertias of the contact arm with the movable contact member and the braking body are designed so that the contact arm is braked and the braking body is moved upon an impact of the contact arm with the braking body.

10 Claims, 2 Drawing Sheets

SWITCHING DEVICE

FIELD OF THE INVENTION

The present invention relate to a switching device having a contact arrangement having at least one movable contact member arranged on a rotatable or displaceable contact arm and at least one stationary contact member.

BACKGROUND INFORMATION

German Patent No. 37 25 860 A1 describes a power circuit-breaker having a contact arrangement including a movable contact member arranged on a rotatable contact arm and a stationary contact member, with a stop being provided to limit the movement of the contact arm in opening the movable contact member. When the contact arm has reached its end position, the arm is prevented from dropping back into the closed position of the contact arrangement by a suitable mechanical gripping device. One disadvantage of such a switching device is that there is the risk when opening the contact arrangement that the contact arm might be thrown back by the stop, especially at high switching capacities, before the mechanical gripping device is operative, so the contact arrangement is unintentionally closed again. There are switching devices, where the stop is provided with a damping layer, so some of the impact energy is absorbed. However, it has not been possible previously to prevent recoil of the contact member at a reasonable cost. Instead, the rate of recoil of the contact arm is simply reduced by the damping layer.

French Patent No. 1,048,980 A describes a switching device according to the definition of the species having a contact arrangement having a movable contact member arranged on a contact arm and a stationary contact member, where the switching device includes a stop in the form of a movably arranged braking body that limits the movement of the contact arm in opening the contact arrangement. After impact, the contact arm moves together with the damping buffer belonging to the braking body until it is braked. There is still the risk here that a contact arm striking with a high energy might be thrown back due to the elasticity of the damping buffer made of cured rubber or an equivalent material.

SUMMARY OF THE INVENTION

Therefore, an object of the present invention is to provide a switching device where the contact arm is braked on reaching its defined end position even in the case of high switching capacities, without then being thrown back by the stop.

The present invention includes a first stop in the form of movably arranged braking body. The first stop is movable as a whole, and the inertias of a contact arm including a movable contact member the braking body that are relevant for impact are approximately equal so that an impact is executed when the contact arm strikes the braking body, so that the contact arm is braked and the braking body is moved. The present invention employs a concept of using a movable braking body as a stop whose material and inertia (i.e., inert mass or moment of inertia) are matched to the contact arm so that when the contact arm strikes the braking body, there is an impact such that the contact arm is strongly braked and the braking body is displaced in a defined direction at a corresponding speed.

The braking body may optionally then be braked by suitable additional means, e.g., a second stop or a spring, after reaching a defined distance. In an advantageous embodiment of the present invention where the braking body is braked by a second stop, a damping body is provided between the braking body and the second stop, braking the movement of the switch arm after it collides with the braking body, if the braking body is in turn moved back into its starting position. This damping body can preferably be used at the same time as a holding element for the braking body. In order for the contact arm not to be struck again by the braking body moving backwards and thus be swung back, it has proven advantageous for the braking body to have a return stop.

In other advantageous embodiments of the present invention, an elastically or plastically deformable material such as lead is used for the braking body. In the latter case, a large portion of the energy of motion of the contact arm can thus be absorbed permanently as soon as the contact member strikes the braking body. In such an embodiment, the permanent deformation of the braking body can also easily be utilized (e.g., by using an inspection window or a pressure sensor, etc.) to display the lifetime of the switching device.

It is advantageous for the braking body to be supported by a guide so that it moves in the direction of impact after impact with the contact arm.

In an advantageous embodiment of the present invention, the switching device is one pole of a power circuit-breaker having two stationary contact members and two movable contact members per pole to be switched, with the movable contact members being attached to the two opposite ends of the contact arm and one braking body being provided for each end of the contact arm. Finally, it is expedient if the contact arm can be pivoted about a centrally positioned axis or if the contact arm is linearly movable.

BRIEF DESCRIPTION OF THE DRAWINGS

Additional details and advantages of the present invention are may be understood from the discussion which follows, with reference to the drawings, in which.

DETAILED DESCRIPTION

Figure 1:
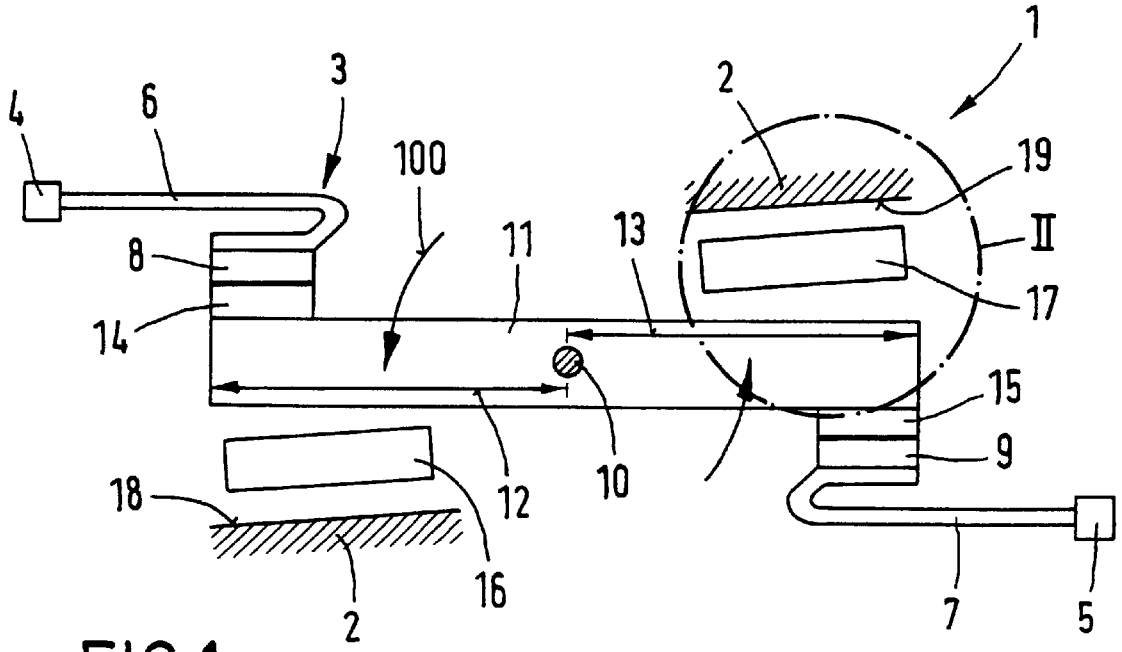
FIG. 1 shows a side view of the contact arrangement of a switching device according to the present invention having two rotatable contact members arranged on one contact arm and two braking bodies opposite the ends of the contact arm, with the contact arrangement being in its closed position.
Figure 2:
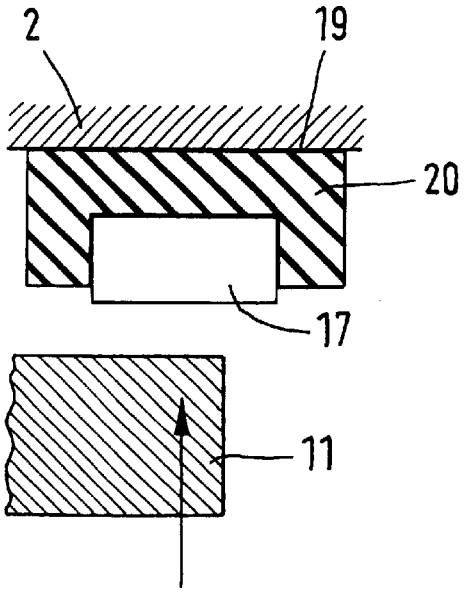
FIG. 2 shows the detail labeled as II in FIG. 1, with the braking body being mounted in a damping body.
Figure 3:
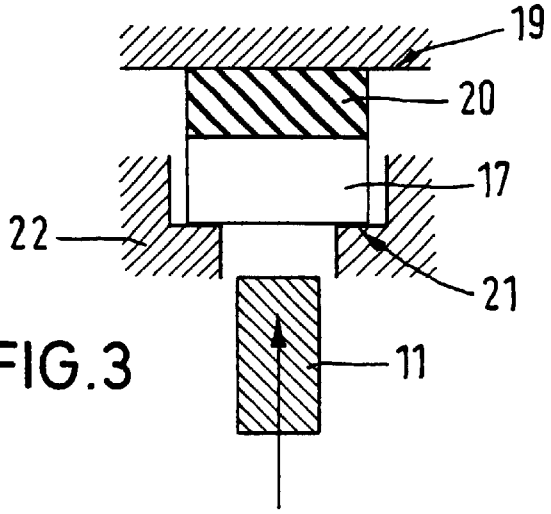
FIG. 3 shows a switching device according to the present invention having a return stop to limit the rebound movement of the braking body.

FIG. 1 shows a power circuit-breaker 1 including an interrupter chamber casing having a casing wall 2, which is indicated only schematically, and a contact arrangement 3 arranged in the casing. Two terminals 4, 5 are provided for connecting power circuit-breaker 1 to a suitable electric circuit and are connected by rail conductors 6, 7 in the form of a loop to two stationary contact members 8, 9. Stationary contact members 8, 9 are bridged by a contact arm 11 rotatable about an axis 10. Both arm halves 12, 13 of rotatable contact arm 11 press against stationary contact members 8, 9 by way of movable contact members 14, 15. A braking body (first stop) 16, 17 is arranged between casing wall 2 and the two sides of contact arm 11 opposite movable contact members 14, 15. The braking bodies are made, for example, of the same material (e.g., copper) as the contact arm. The masses of both braking bodies 16, 17 are matched to the mass of contact arm 11 including movable contact members 14, 15 so that an elastic impact is executed with an opening movement in the direction indicated by arrows 100 when contact arm 11 strikes respective braking body 16, 17, so that contact arm 11 is strongly braked (ideally braked completely) and respective braking body 16, 17 is displaced toward casing wall 2 at a corresponding rate. Casing wall 2 is designed as a second stop 18, 19 for braking the braking body in the impact area of respective braking body 16, 17. As shown in FIG. 2, respective braking body 16, 17 is preferably mounted in a damping body 20 made of a flexible material (preferably rubber) whose movement is partially braked after impact of contact arm 11 against braking body 16, 17. To prevent contact arm 11 from being swung back again by braking bodies 16, 17 moving back, it has proven advantageous to provide a return stop for respective braking body 16, 17. FIG. 3 shows a corresponding embodiment of a return stop 21, where the return stop is formed by the inside step of a step recess of a corresponding carrier part 22.

The present invention is of course not limited to the embodiments described here. For example, the contact arm can be braked by a movable braking body not only when using rotatable contact arms but also when using displaceable contact arms. Furthermore, a spring having a corresponding characteristic may also be used as the damping body. In addition, the respective braking body need not be arranged in the area of the ends of the contact arm, as shown in the figures, but in particular with regard to implementation of a straight central impact of the impacting body with the impacted body, it may be arranged so that the direction of impact coincides with the line connecting the mid points of the contact arm (or contact arm half) and the braking body.

Figure 4:
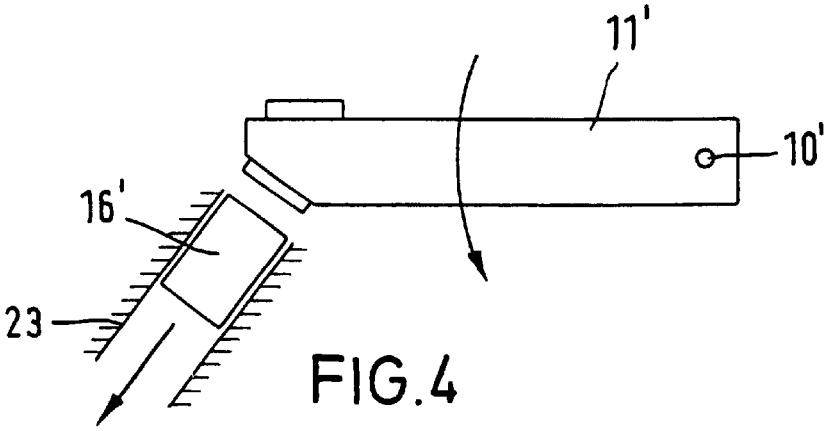
FIG. 4 shows a side view of another embodiment of the present invention, with the braking body being arranged displaceably at an angle of about 45° to the movement of the contact arm.

The braking body need not necessarily be displaced in the direction of the opening movement of the contact arm, but instead it may also move in another direction, should this be necessary for reasons of space, for example. FIG. 4 illustrates such an embodiment, showing a contact arm 11' which can pivot about an axis 10'; in its opening movement, it strikes against a braking body 16' supported by a guide 23 in such a way that it is displaced obliquely outward along guide 23.

Figure 5:
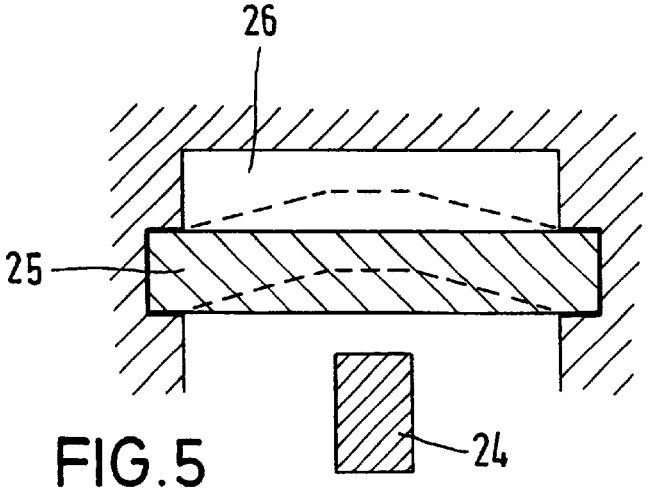
FIG. 5 shows a section through one embodiment of the present invention, where the braking body is made of a plastically deformable material.

Furthermore, the material of the braking body need not necessarily be only an elastically deformable material. Instead, the braking body may also be at least partially plastically deformable. Lead, for example, may be used as the material in this case. Therefore, a large portion of the energy of motion of the contact arm is absorbed permanently as soon as the contact member strikes the braking body. In such an embodiment, the permanent deformation of the braking body can also easily be utilized to display the lifetime of the switching device. FIG. 5 shows a corresponding embodiment of an arrangement having a braking body made of a plastically deformable material. Contact arm 24 is indicated only schematically, and plastically deformable braking body 25 is also shown. A deformation space 26 into which the braking body can yield (dotted line) when the contact arm strikes is provided on the side facing away from contact arm 24.

What is claimed is:

1. A switching device comprising:

an openable contact arrangement including at least one movable contact member disposed on a movable contact arm and including at least one stationary contact member; and at least one movable braking body for limiting a movement of the contact arm in opening the contact arrangement;

a first inertia of the contact arm and the movable contact member together being approximately equal to a second inertia of the at least one braking body so as to brake the contact arm and move the braking body upon an impact of the contact arm with the braking body.

2. The switching device as recited in claim 1 wherein the contact arm is at least one of rotatable and displaceable.

3. The switching device as recited in claim 1 wherein the contact arm is pivotable about a central axis.

4. The switching device as recited in claim 1 further comprising a braking device for braking a movement of the braking body caused by the impact with the contact arm and then moving the braking body into a starting position.

5. The switching device as recited in claim 4 wherein the braking device includes at least one of a stop, a spring and a stationary damping body.

6. The switching device as recited in claim 4 further comprising a return stop (21) for limiting a movement of the braking body in a direction of the contact arm.

7. The switching device as recited in claim 1 wherein the braking body includes an elastically deformable material.

8. The switching device as recited in claim 1 wherein the braking body includes a plastically deformable material for permanently absorbing a major portion of an energy of motion of the contact arm in the impact of the contact arm with the braking body.

9. The switching device as recited in claim 1 further comprising a guide for supporting the braking body so as to enable the braking body to move in a direction of the impact after the impact with the contact arm.

10. The switching device as recited in claim 1 wherein the switching device is included in a pole of a power circuit-breaker, the at least one stationary contact member including two stationary contact members, the at least one movable contact member including two movable contact members, the at least one braking body including two braking bodies, the two movable contact members being disposed on opposite ends of the contact arm and the two braking bodies being associated with the opposite ends of the contact arm.

* * * * *